US006382639B1

(12) United States Patent
Scherner

(10) Patent No.: US 6,382,639 B1
(45) Date of Patent: May 7, 2002

(54) IN-LINE SKATE WITH SUSPENSION

(76) Inventor: Tyler Scherner, 2998 NW. Overlook Dr., #1622, Hillsboro, OR (US) 97124

( * ) Notice: Subject to any disclaimer, the term of this patent is extended or adjusted under 35 U.S.C. 154(b) by 0 days.

(21) Appl. No.: 09/851,035

(22) Filed: May 7, 2001

(51) Int. Cl.[7] ..... A63C 17/04
(52) U.S. Cl. ..... 280/11.224; 280/11.28
(58) Field of Search ..... 280/11.19, 11.221, 280/11.223, 11.224, 11.225, 11.231, 11.27, 11.28, 11.3

(56) References Cited

U.S. PATENT DOCUMENTS

| | | | | | |
|---|---|---|---|---|---|
| 301,522 | A | * | 7/1884 | Richardson | 280/11.28 |
| 619,370 | A | * | 2/1899 | Wagner | 280/11.115 |
| 4,962,834 | A | * | 10/1990 | Miner | 188/321.11 |
| 5,465,984 | A | * | 11/1995 | Pellegrini et al. | 188/5 |
| 5,503,413 | A | | 4/1996 | Belogour | |
| 5,586,774 | A | | 12/1996 | Dentale | |
| 5,823,543 | A | * | 10/1998 | Burns et al. | 280/11.225 |
| 5,918,889 | A | | 7/1999 | Tai | |
| 6,131,920 | A | * | 10/2000 | Roman et al. | 280/11.2 |
| 6,135,464 | A | * | 10/2000 | Borel | 280/11.22 |
| 6,227,550 | B1 | * | 5/2001 | Maggiolo | 280/11.223 |

FOREIGN PATENT DOCUMENTS

DE 29616315 U1 * 1/1997

* cited by examiner

*Primary Examiner*—Christopher P. Schwartz
*Assistant Examiner*—Xuan Lan Nguyen
(74) *Attorney, Agent, or Firm*—Robert E. Howard

(57) ABSTRACT

An in-line skate having a suspension means that reduces or eliminates lateral movement of the skate boot. The in-line skate has a wheel chassis with a plurality of tandem wheels rotatably mounted thereon and a boot attached to the chassis. The diameter of the wheels preferably decreases from the toe end to the heel end of the chassis. The toe of the boot is pivotally attached to the chassis. A cylindrical suspension guide member extends vertically along a portion of the back of the boot and has a central bore located therein. A suspension chassis includes a pair of substantially parallel vertically disposed guide posts with a horizontal guide plate extending between the upper ends of the vertical guide posts and around the back of the boot. A stabilizer rod extends upwardly from the heel end of the wheel chassis. The stabilizer rod extends through the bore of the cylindrical guide member and through a bore extending vertically through the horizontal guide plate. A spring is positioned around the stabilizer rod and is adapted to be compressed by the suspension guide member when the rear of the wheel chassis moves upward or the rear of the boot moves downward.

3 Claims, 4 Drawing Sheets

IN-LINE SKATE WITH SUSPENSION

BACKGROUND OF THE INVENTION

The present invention relates to an in-line skate structure having a laterally stable suspension mechanism.

In-line skates have been in use for a number of years. Such skates typically include a chassis, a plurality of tandem wheels rotatably attached to the chassis, and a boot attached to the upper surface of the chassis.

Such a construction is rigid, and vibrations caused by skating over an uneven surface are directly transmitted to the feet and legs of the skater.

It has been suggested in the prior art to incorporate shock absorbing suspension means between the boot heel and chassis. Exemplary of such suggestions are those described in U.S. Pat. Nos. 5,503,413 and 5,586,774. From the descriptions of these devices it would appear that they would be laterally unstable, i.e., the skater's boot would tend to wobble from side to side.

SUMMARY OF THE INVENTION

It is an object of the present invention to provide an in-line skate with a suspension mechanism that reduces or eliminates lateral movement of the skate boot.

It is a further object of the present invention to provide such a suspension mechanism that permits boot flexure.

These and other objects are accomplished by providing an in-line skate suspension mechanism that includes vertical post members extending upwardly from the wheel chassis adjacent both sides of the boot and vertical spring suspension means extending upwardly from the chassis adjacent the rear of the boot. The vertical post members and the vertical suspension means are adapted to permit boot flexure, i.e., permit the boot to bend when the skater leans forward.

The in-line skate of the present invention has a chassis with a toe end and a heel end. A plurality of tandem wheels are rotatably attached to the chassis. Preferably, the diameter of the wheels decreases from the toe end to the heel end of the chassis to permit greater travel distance for the suspension means.

A boot is pivotally attached to the toe end of the chassis.

A vertically disposed suspension guide means having a vertical bore extending therethrough is attached to the stationary portion of the rear of the boot and is preferably integral therewith.

The suspension means includes a pair of substantially parallel vertical posts extending upwardly from the chassis with a horizontal guide plate extending between the upper ends of the posts and around the back of the boot.

A suspension stabilizing rod is attached at its lower end to the chassis, and extends upwardly through the bore in the suspension guide means and through a bore in the horizontal guide plate.

A spring means is positioned around the stabilizing rod and is adapted to be compressed by the suspension guide means when the heel end of the chassis moves upwardly or the boot moves downwardly.

The vertical post members terminate at their upper ends adjacent the ankle location of the boot. Concave circular cups are located on opposite sides of the boot in the ankle location. A circular disk is located within each cup and non-rotatably attached to an axle located at the center thereof. A roller bearing is rotatably attached to an axle extending through the disk at a location below the disk axle, between the disk axle and the edge of the disk. The roller bearing axle passes through a longitudinally extending slot in the ankle post and rides in a longitudinally extending channel located within the axle post.

The vertical post member structure assists in preventing lateral movement of the boot, and, together with the pivotal attachment of the stabilizer rod to the chassis, permits horizontal boot flexure.

DESCRIPTION OF THE PREFERRED EMBODIMENTS

Figure 1:
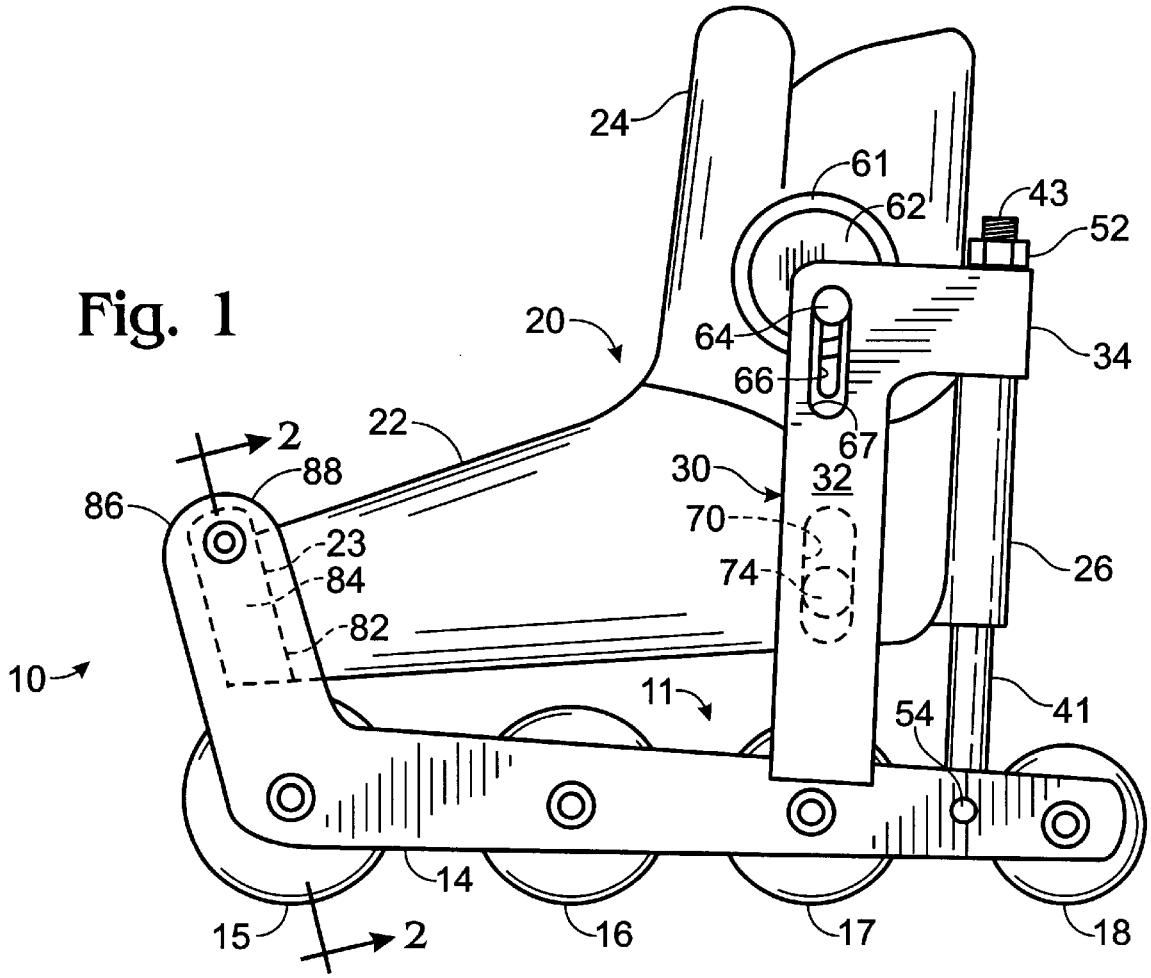
FIG. 1 is a side elevation view of the in-line skate of the present invention.

The in-line skate 10 of the present invention has a wheel chassis 11 comprised of a pair of opposed, parallel side rails 13 and 14. Wheels 15, 16, 17, and 18 are arranged in tandem between side rails 13 and 14 and connected thereto by conventional axles and bearings (not shown). The diameter of wheels 15–18 preferably decreases from the toe end of in-line skate 10 to the heel end thereof, as shown.

Boot 20 is comprised of a foot portion 22 and a lower leg portion 24. Lower leg portion 24 is preferably pivotally attached to foot portion 22 by pivotal attachment means (not shown), such pivotal attachment means being well known in the boot art. Foot portion 22 terminates at toe 23.

Cylindrical suspension guide member 26 is vertically disposed along the center of the back of the stationary portion of the boot, i.e., the back of the foot portion 22 of boot 20, and is preferably integral therewith. Suspension guide member 26 extends from adjacent the upper portion of stationary lower leg portion 22 to adjacent the bottom (sole) of the rear of the boot 20. A vertically disposed bore 27 extends through the body of suspension guide member 26, bore 27 and cylindrical suspension guide member 26 having a common longitudinal axis. The lower end of the body of suspension guide member 26 is open and the upper end has a rod opening therein for receiving the upper end 43 of rod 40 therethrough.

A suspension chassis means 30 includes a pair of vertical post members 32, a U-shaped upper horizontal guide plate 34 extending between the upper ends of vertical post members 32 and around the backside of boot 20, and lower horizontal attachment members 36 extending from the lower ends of vertical members 32 and connecting to side rails 13 and 14. Preferably, vertical post members 32, upper horizontal guide member 34 and lower horizonal attachment members 36 are integral with each other and with side rails 13 and 14.

Figure 5A:
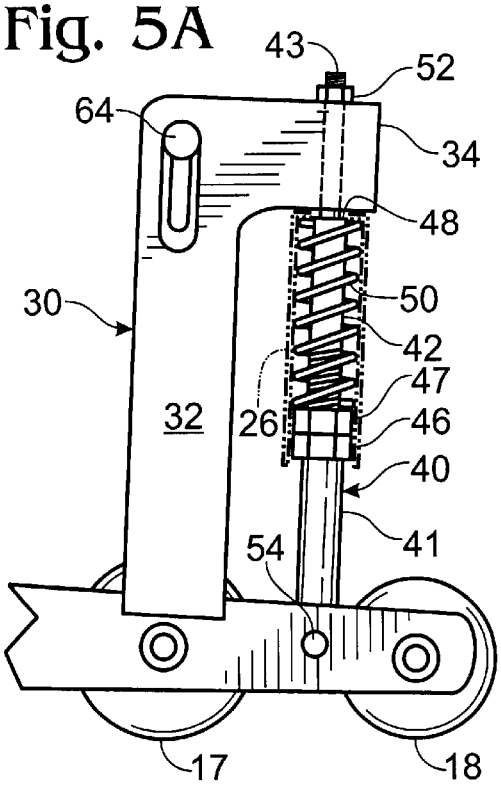
FIG. 5A is a partial side elevation view of the suspension mechanism of the invention, shown in the uncompressed state.
Figure 5B:
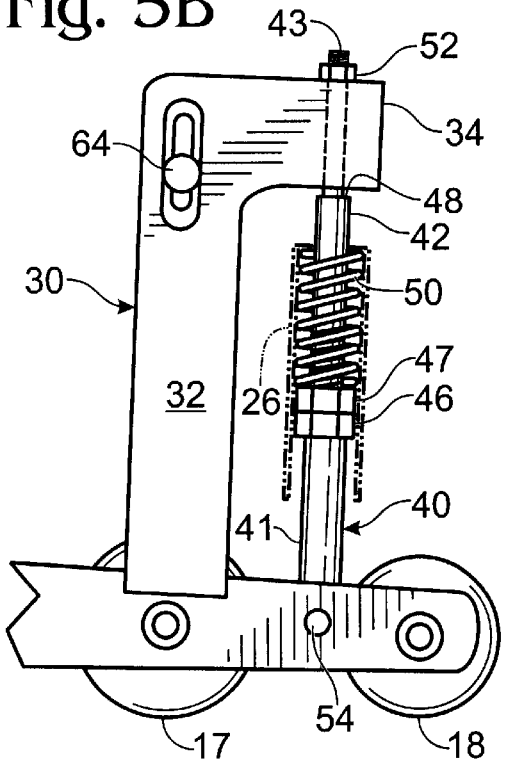
FIG. 5B is a partial side elevation view of the suspension mechanism of the invention, shown in the compressed state.
Figure 10:
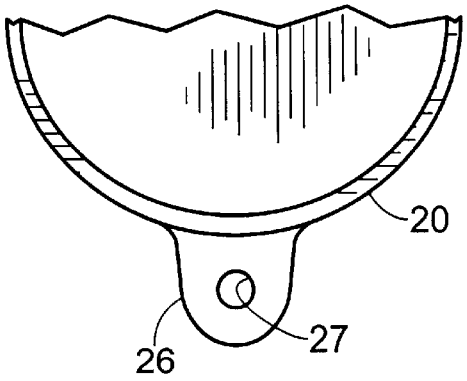
FIG. 10 is a partial top plan view of the rear of the boot.
Figure 6:
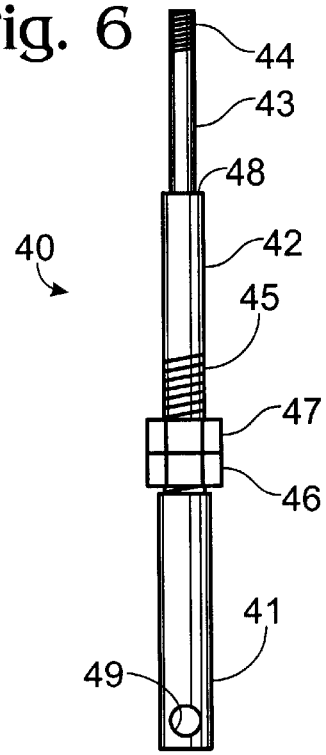
FIG. 6 is an elevation view of the suspension stabilizing rod.

The suspension system, as best seen in FIGS. 5A and 5B, includes a cylindrical suspension stabilizing rod 40 (shown separately in FIG. 6).

Rod 40 includes a lower end portion 41, a mid-portion 42, and an upper end portion 43. The diameter of mid-portion 42 is smaller than the diameter of lower end portion 41 and larger than the diameter of upper end portion 43. The outer end of upper portion 43 and the lower end of mid-portion 42 contain external threads 44 and 45, respectively.

Lock nut 46 and spring compression adjustment nut 47 are threadably mated to threads 45 at the lower end of mid-portion 42.

A shoulder 48 is formed at the juncture of mid-portion 42 and upper portion 43.

Pin hole 49 for accommodating pin 54 passes through lower portion 41.

A spring member 50 is located on the outer surface of mid-portion 42 of spring rod 40, and extends between the lower surface of the upper end of suspension guide member 26 and spring compression adjusting nut 47. By screwing tension adjustment nut 47 up or down the compression forces acting on spring 50 can be increased or decreased, respectively. Compression adjustment nut 47 is held in its selected location by lock nut 46.

FIG. 5A shows the suspension mechanism of the present invention in its uncompressed state. In the uncompressed state, spring member 50 is fully expanded and the top of suspension guide member 26 is in abutment with the bottom of upper horizontal guide member 34.

FIG. 5B shows the suspension mechanism of the present invention in its compressed state. The compressed state is caused by boot 20 and the rear end of chassis 11 moving towards each other, which can be caused by the rear end of chassis 11 being forced upwards by wheels 16–18 passing over a patch of rough roadway or by the user pushing down on his heels in order to execute an in-line skate maneuver. In the compressed state suspension guide member 26 has moved downwards relative to chassis 11, thereby compressing spring member 50.

Lower portion 41 of rod 40 extends downwardly between side rails 13 and 14 and is attached thereto by pin 54.

Upper portion 43 of rod 40 extends through rod bore 35 (see FIG. 3) in upper horizontal guide member 34 with the threaded outer end of upper portion 43 extending above the upper surface of upper horizonal guide member 34. A nut 52 is screwed thereon and tightened into closely abutting relationship with the upper surface of upper horizontal guide member 34 when the skate 10 is not in use. In this configuration, shoulder 48 is located below the lower surface of upper horizontal guide member 34 with the upper end of suspension guide member 26 being located therebetween with the upper portion of 43 of rod 40 passing through a central opening in the upper end of suspension guide member 26.

Vertical post members 32 extend upwardly from rails 13 and 14 with their ends terminating in the mid-portion (ankle) of the lower leg portion 24. Concave circular cups 61 are attached to boot 20 on opposite sides of lower leg portion 24, substantially at the location of a user's ankle.

Figure 7:
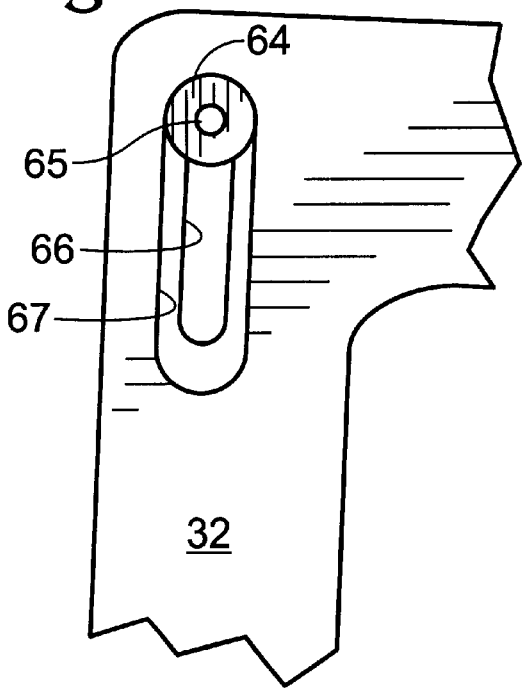
FIG. 7 is a partial, enlarged elevation view of the upper end of the vertical post member of the invention.
Figure 8:
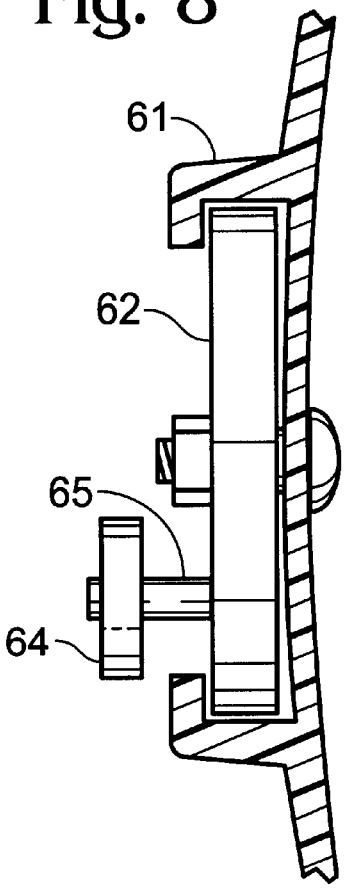
FIG. 8 is an enlarged top plan view of the pivotal connection between the vertical post member and the boot.
Figure 9:
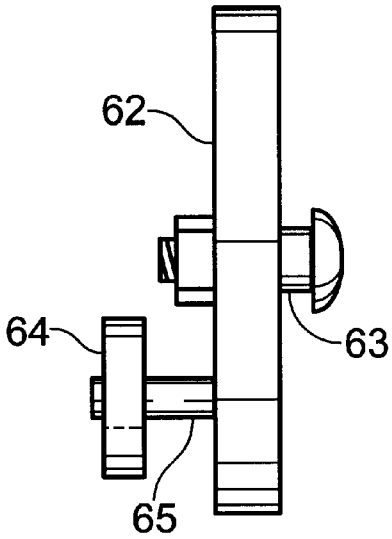
FIG. 9 is an enlarged side elevation view of the pivotal connection between the vertical post member and the boot.

As best seen in FIGS. 7–9, a circular disk 62 is rotatably positioned within each cup 61. Disk 62 is non-rotatably attached to an axle 63 located in the center thereof. Axle 63 is rotatably attached at its inner end to cup 61. A roller bearing 64 is located below axle 63 and rotatably attached to an axle 65, the axle being attached at its inner end to disk 62 at a location between axle 63 and the lower edge of disk 62. Axle 65 passes through a substantially vertically extending slot 66 in post 32, and roller bearing 64 rides in a substantially vertically extending channel 67 located within post 32.

Figure 3:
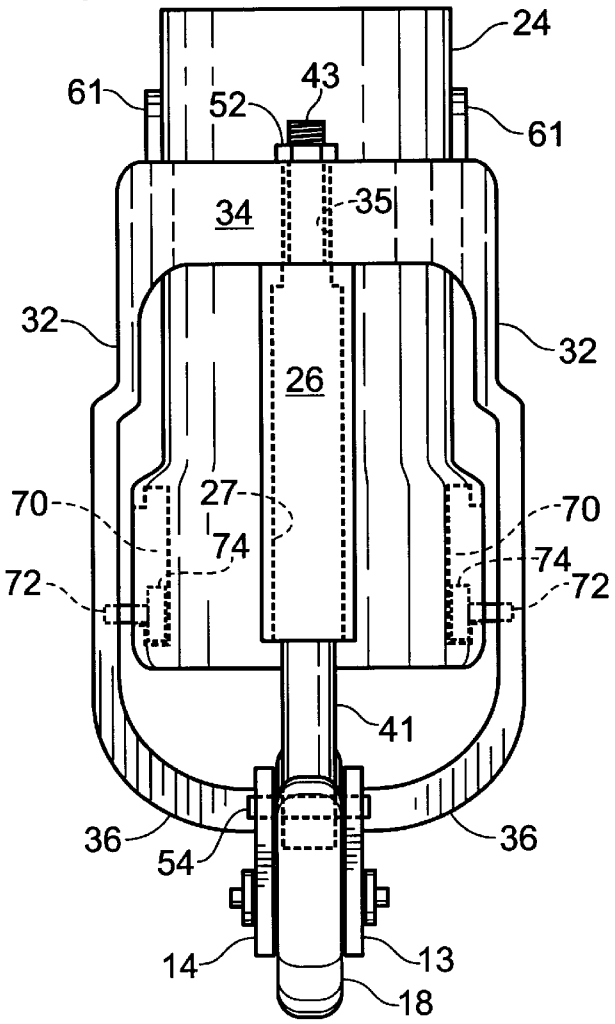
FIG. 3 is a rear elevation view of the in-line skate of the present invention.

As best seen in FIGS. 1 and 3, a pair of slots 70 are located in the sides of boot 20 adjacent the heel thereof. A pair of stub axles 72 extend inwardly from the inner surfaces of vertical members 32. Roller bearings 74 are rotatably attached to the inner ends of stub axles 72

Figure 2:
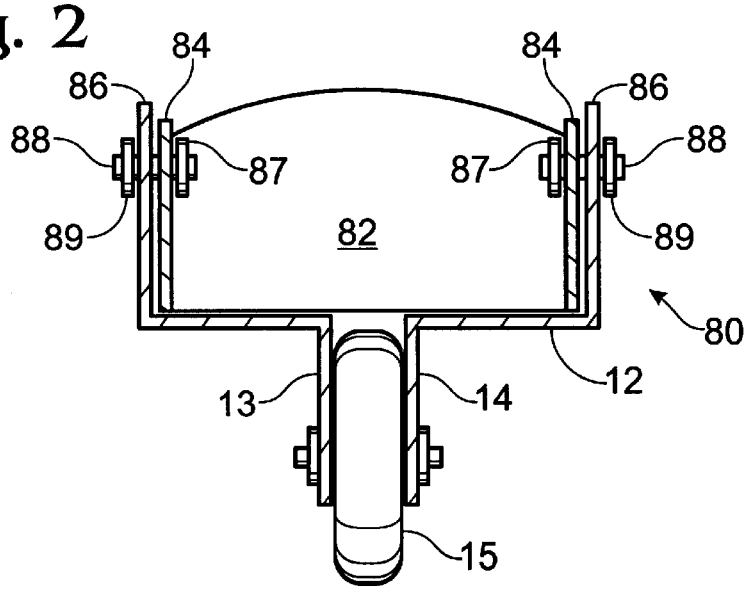
FIG. 2 is a front elevation view of the in-line skate of the present invention taken along line 2—2 of FIG. 1.
Figure 4:
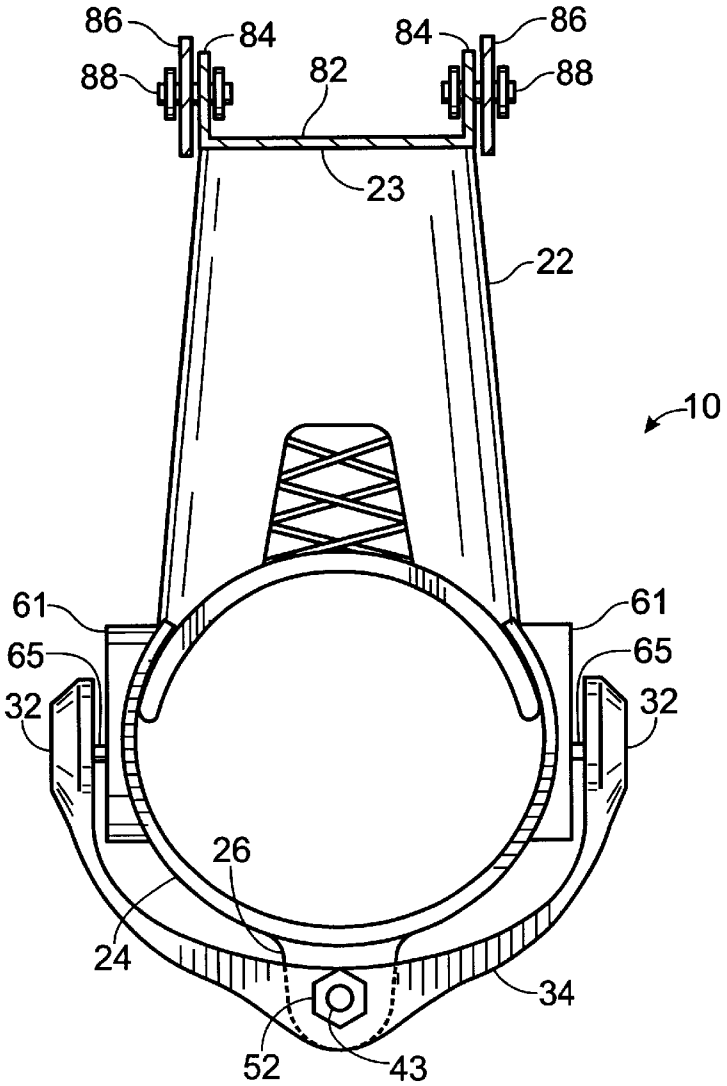
FIG. 4 is a top plan view of the in-line skate of the present invention.

As best seen in FIGS. 1, 2 and 4, toe 23 has a pivot attachment yoke 80 attached thereto. Yoke 80 is comprised of a pivot yoke base plate 82 attached to toe 23. A pair of spaced, parallel pivot yoke flanges 84 extend outwardly from base plate 82. Vertically disposed pivot plates 86 extend upwardly from side rails 13 and 14. Pivot pins 88 extend through openings in the upper body portions of pivot yoke flanges 84 and pivot plates 86. Pivot pins 88 are secured at their inner and outer ends by suitable stop members 87 and 89, as shown in FIG. 2.

In operation, chassis 11 can pivot about toe 23 by means of pivot pins 88 as the rear of chassis 11 moves vertically upward in response to an upward force being applied to the wheels 15–18 of in-line skate 10 by roadway roughness. Such upward motion of the rear of chassis 11 causes spring 50 to be compressed, as seen in FIG. 5B, thereby cushioning the shock or vibration causing such upward force to be applied to chassis 11 of in-line skate 10. Such upward movement of chassis 11 causes vertical members 32 to also rise, and roller bearing 64 moves downwardly in channel 67.

Also during such upward movement of chassis 11, roller bearings 74 move upwardly in slots 70.

In addition to providing cushioning during upward movement of chassis 11, the suspension means of the present invention also allows the skater to provide himself with an upward force for certain skating maneuvers by suddenly hunkering down thereby causing the heel of boot 20 to lower and compress spring 50, such as shown in FIG. 5B, which then provides an upward force to the boot when it uncompresses.

If the skater desires to lean forward, disk 62 located within cup 61 and roller bearing 64 located within channel 67 both rotate to thereby permit the ankle portion 22 of boot 20 to move forward.

By having the diameters of wheels 14–17 decrease from the front of in-line skate 10 to the rear thereof more 'space is provided for the heel end of chassis 11 to vertically travel during compression of spring 50, the compression characteristics of spring 50 preferably being selected to allow for a compression of between about 1.0 and about 2.0 inches for a skater of average weight. The compression characteristics of spring 50 can be more finely adjusted by moving nuts 46 and 47 up and down.

Suitable strengthening cross members (not shown) can be extended between or across side plates 13 and 14 at locations other than where wheels 15–18 are located.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An in-line skate comprising:

a wheel chassis having a toe end and a heel end;

a plurality of tandem wheels rotatably attached to said wheel chassis;

a boot having a foot portion and a lower leg portion extending upwardly from said foot portion, said boot having front and rear ends and right and left sides;

said foot portion of said boot including a toe at its front end and a heel at its rear end;

said toe being pivotally attached to the toe end of said wheel chassis;

said boot having a vertical suspension guide member attached to and extending vertically along at least part of the rear of said boot, said vertical suspension guide member including a body having a bore extending longitudinally therethrough, an open lower end and an upper end having a centrally located rod opening therein;

a suspension chassis including first and second substantially parallel vertical post members extending upwardly from said wheel chassis adjacent the sides of said boot and terminating at upper ends, said post members being vertically slidably attached to said foot portion of said boot, and a horizontal guide member extending between the upper ends of said vertical post members and around the rear of said boot, said horizontal guide member having a rod bore extending therethrough;

a rod having upper and lower ends and a mid-portion, the mid-portion of said rod extending through said bore of said vertical suspension guide member and having spring retention means at the lower end thereof, said rod being attached at its lower end to said wheel chassis, the upper end of said rod extending through said rod opening in the upper end of said vertical suspension guide member and through said rod bore in said horizontal guide member of said suspension chassis, said upper end of said rod being attached to said horizontal guide member; and spring means having upper and lower ends extending around the mid-portion of said rod between the upper end of said vertical suspension guide member and said spring retention means, said upper end of said spring means abutting against the upper end of said vertical suspension guide member, said spring being adapted to be compressed by said vertical suspension guide member in response to upward movement of said wheel chassis or downward movement of the rear of said boot.

2. The in-line skate of claim 1 wherein said lower leg portion of said boot is pivotally attached to said foot portion, and said vertical post members of said suspension chassis are rotatably attached to the sides of said lower leg portion.

3. The in-line skate of claim 1 including:

first and second circular cups attached to said right and left sides, respectively, of said lower leg portion, first and second circular disks rotatably positioned within said first and second circular cups, respectively, first and second roller bearings rotatably attached to said first and second circular disks, respectively, said first and second post members of said suspension chassis having first and second channels, respectively, in which said first and second channels said first and second roller bearings are rotatably and slidingly engaged.

* * * * *